United States Patent [19]

Kimpel et al.

[11] Patent Number: 4,509,025

[45] Date of Patent: Apr. 2, 1985

[54] POLARIZED ELECTROMAGNETIC RELAY

[75] Inventors: Rolf-Dieter Kimpel, Unterschweinbach; Ulf Rauterberg; Horst Tamm, both of Munich, all of Fed. Rep. of Germany

[73] Assignee: Siemens Aktiengesellschaft, Berlin & Munich, Fed. Rep. of Germany

[21] Appl. No.: 401,235

[22] Filed: Jul. 23, 1982

[30] Foreign Application Priority Data

Aug. 14, 1981 [DE] Fed. Rep. of Germany ..... 3132244

[51] Int. Cl.[3] ..... H01H 51/22

[52] U.S. Cl. ..... 335/85; 335/79; 335/81

[58] Field of Search ..... 335/78, 79, 80, 81, 335/83, 85, 86

[56] References Cited

U.S. PATENT DOCUMENTS 4,215,329 9/1980 Kobler ..... 335/78

*Primary Examiner*—William M. Shoop
*Assistant Examiner*—Jeffrey Sterrett
*Attorney, Agent, or Firm*—Hill, Van Santen, Steadman & Simpson

[57] ABSTRACT

An electromagnetic relay has a hallow coil body and coil having a longitudinal axis with a bar-shaped armature pivotably mounted for movement in and extending through the coil body, a permanent magnet arrangement having polarization directions perpendicular to the coil axis, two yokes disposed in a single plain parallel to the permanent magnet arrangement, two pole plates connected to the yokes and also extending perpendicular to the coil axis, and a flux plate overlapping and spaced from the yokes and having a flat segment with the magnet arrangement being disposed in the volume defined between the overlapping area of the flux plate and the yokes, the magnet arrangement extending substantially longitudinally parallel to the coil axis. The structural arrangement of the flux plate and yokes so as to define a volume which can accommodate the magnet system permits the magnet system to be encompassed within the relay without adding to the overall length thereof, thereby adapting the relay to miniaturization. Additionally, the surfaces of the yokes and permanent magnet can exhibit a relatively large area, again without causing any increase in the length of the relay.

16 Claims, 5 Drawing Figures

POLARIZED ELECTROMAGNETIC RELAY

BACKGROUND OF THE INVENTION

FIELD OF THE INVENTION

The present invention relates to polarized electromagnetic relays, and in particular to such relays having a bar-shaped armature mounted at one end and disposed inside the coil body of the relay approximately along the coil axis, the free end of the armature projecting into the space between two opposed pole plates and being movable therebetween.

RELATED APPLICATION

This application is related to the co-pending application of R.-D. Kimpel, H. Tamm, W. Huebner and E. Steiger, filed simultaneously herewith and assigned Ser. No. 401,236 the teachings of which are incorporated herein by reference.

DESCRIPTION OF THE PRIOR ART

A polarized electromagnetic relay having a quadripole permanent magnet arrangement is known from U.S. Pat. No. 4,215,329. The relay has an armature which is mounted at one end thereof and has a free movable end extending through the interior of the coil body and terminating in an end which is disposed between two opposed pole plates. The pole plates extend along the length of the relay to form two yokes disposed even with and next to one another and which are respectively couple to two opposite poles of the quadripole permanent magnet system. The two poles of the permanent magnet system opposite the yokes are coupled to each other by means of a flux plate as well as to the mounted end of the armature.

The permanent magnet arrangement in this conventional structure is disposed at one end face of the coil body and a ferromagnetic housing cap is utilized as the flux plate. Additional flux transfer elements formed on the yokes achieve a particularly good coupling of the control flux so that the relay can be made very sensitive. Additionally, the use of the quandripole permanent magnet arrangement permits adjustment of the relay to different switching characteristics without undertaking any structural changes to the relay, the adjustment being achieved solely by calibrating the two permanent magnet areas of the magnetic arrangement by changing the magnetization thereof. Thus, even after the relay has been completely assembled, the relay can be adapted to monostable or bistable switching behavior, and may further be adapted to exhibit different reponse values for the two armature positions.

SUMMARY OF THE INVENTION

It is an object of the present invention to provide a polarized electromagnetic relay having a quadripole magnetic circuit which has larger pole surfaces available for magnetic coupling than in conventional relays, thereby permitting a very precise optimization of the contact force attainable by means of the permanent magnet, and the response sensitivity attainable as a result of improved coupling of the control flux circuit.

It is a further object of the present invention to provide a relay having space for at least two switching contact elements actuatable by the armature.

The above objects are inventively achieved in a relay wherein the magnet system is structured so as to increase the pole surfaces available for magnetic coupling and which permits adjustment of the response sensitivity by adjustment of air gaps parallel to the permanent magnets. Specifically, the relay disclosed and claimed herein has two yokes which constitute bent sections of a larger element which also includes the pole plates, and a flux plate which is coupled to the armature bearing and which is similarly bent to extend parallel to the yokes and to the coil axis. The two yokes and the flux plate form an overlapping area next to the coil winding in which the permanent magnet arrangement with polarization directions substantially perpendicular to the coil axis is disposed.

Because of the placement of the quadripole permanent magnet arrangement, which may be a single magnet, next to the coil winding, the pole surfaces can be made significantly larger than in conventional relays utilizing end-face coupling. This structure is particularly favorable in relays having a longer coil with a small cross-section. Positioning the permanent magnet or magnets next to the coil winding means that the magnet is disposed above the winding in the radial direction. As viewed from the connection side of the relay, the magnet may be disposed below, to the side of, or above the coil. This permits the advantages of very thin magnets which have a very small extension in the so-called privileged direction such as, for example, ferrite magnets, to be exploited. Such a flat magnet, which has an extension in the direction parallel to the coil axis that is a multiple of its extension in the magnetization direction (substantially perpendicular to the coil axis), will increase the total height of the relay by only a small amount because of its positioning next to or above the coil winding. Because the entire length of the coil is then available for the length of the yokes and the flux plate and for the overlapping area of those parts. Moreover, the pole surface of the permanent magnet can be selected to be an optimum size, without consideration of significant spatial limitations.

In addition to the good coupling of the permanent magnetic circuit in the relay disclosed and claimed herein due to the large pole surfaces, coupling of the excitation current is also good because the large surfaces of the yokes and the flux plate are situated opposite one another in the overlapping area and thus form a favorable air gap for transfer of the control flux. The volume defined by the overlapping area of the yokes and the flux plate need not be entirely filled by the permanent magnet, so that a further air gap may exist next to the permanent magnet which further facilitates transfer of the control flux. As mentioned above, a very thin permanent magnet can be utilized so that the spacing, which is the determining factor for the magnetic resistance of the air gap in combination with its surface area, can be maintained very low. In order to reduce the magnetic resistance of the air gap between the yokes and the flux plate, additional tabs may be formed on those parts, the tabs enabling a further reduction of the spacing in the region next to the permanent magnets and thus further improving flux transfer. Because this air gap also forms a shunt for the permanent magnet, the air gap is selected only small enough such that sufficient permanent flux is still available for generating the retaining forces for the armature. Each relay may be adjusted so as to optimize the competing relay characteristics of the required contact force generated by the permanent magnet and the response sensitivity of the relay attainable by means of good conductive connection of the control flux circuit.

In a preferred embodiment of the invention, the two pole plates are formed as part of respective unitary elements as segments of the yokes which are bent at the end face of the coil body in the direction toward the free armature end and parallel to the flat side of the armature such that the flat sides of the pole plates are situated opposite the armature and form large pole surfaces overlapping the armature. The yokes are preferably disposed between the permanent magnet arrangement and the coil winding so that the bent portions forming the pole plates do not intersect with the magnets or with the flux plate. The flux plate which is disposed at the outside of, and over, the permanent magnet may be relatively thin and achieves a good coupling of external pole shoes for balancing and calibrating the two permanent magnet areas. In order to observe a prescribed spacing between the two pole plates, the spacing corresponding to the armature stroke, seating surfaces are provided on the coil body. In a further embodiment the coil flanges may be provided with noses integrally formed thereon by means of which the pole plates are pressed against the seating surfaces. During assembly of the yokes, the two pole plates may thus be inserted between the seating surfaces and the noses. In order to fasten the yokes as well as the permanent magnet arrangement to the flux plate, pegs may be formed on the coil flanges. The pegs of the thermo-plastic coil body extend through corresponding bores in the flux plate and the ends of the pegs are flattened to form rivet heads.

In another embodiment of the relay, a permanent magnet arrangement with the yokes and the flux plate is wider than the diameter of the coil, so that a space for contact elements is formed at both sides of the coil below the yokes. This space is terminated at the underside of the relay by a base body in which the contact terminals are anchored. The base body, consisting of insulating material, may further have a central recess for press-fit acceptance of the coil body so that the precise spacing between the pole surfaces of the pole plates and the contact elements actuated by the armature is insured. The relay is closed by means of a cap consisting of insulating material which is inverted over the coil and is sealed to the base body.

DESCRIPTION OF THE PREFERRED EMBODIMENTS

Figure 1:
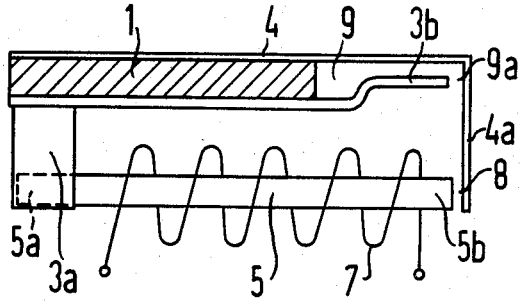
FIG. 1 is a side view of a simplified schematic diagram describing the concept of operation of a relay constructed in accordance with the principles of the present invention.
Figure 2:
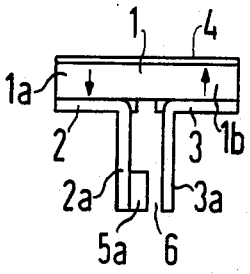
FIG. 2 is an end view of the simplified schematic structure shown in FIG. 1.
Figure 5:
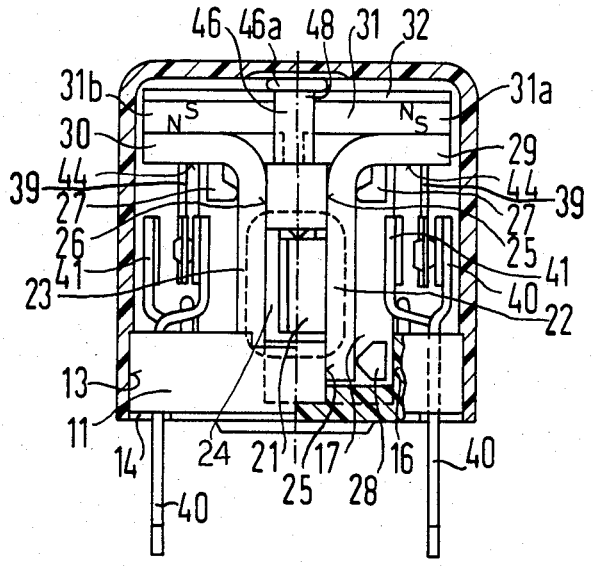
FIG. 5 is an end sectional view taken along line V—V of FIG. 3, of a relay constructed in accordance with the principles of the present invention.

The concept of operation and a simplified version of the structure of a relay of the type disclosed and claimed herein is shown in FIGS. 1 and 2. The magnet system shown therein has a flat permanent magnet 1 with two oppositely polarized magnet regions 1*a* and 1*b*. Two yokes 2 and 3 are respectively coupled to the magnet regions 1*a* and 1*b*, with the opposite poles of the permanent magnet 1 being coupled to a flux plate 4. Pole plates 2*a* and 3*a* are respectively formed by bent segments of the respective unitary elements also forming the yokes 2 and 3. The pole plates 2*a* and 3*a* are disposed at opposite sides of the free end 5*a* of a bar-shaped armature 5 and form a working air gap 6 in combination therewith. The pole plates 2*a* and 3*a* are substantially parallel to the flat sides of the armature 5. The armature is disposed inside a coil 7 substantially along the coil axis and is mounted at its opposite end 5*b* in a mounting or seating means not shown in FIGS. 1 and 2. A bent leg 4*a* of the flux plate 4 is coupled to the mounted or fixed end 5*b* of the armature and forms a small air gap 8 in combination therewith. As stated earlier, and as shown in FIG. 2 and FIG. 5, the oppositely polarized magnet regions 1*a* and 1*b* have polarization directions extending perpendicular to the longitudinal axis of the coil 7. In this context, the term "perpendicular" as used herein means that if the base body 11 of the relay is generally horizontally disposed, the directions of polarization of the regions 1*a* and 1*b* proceed substantially vertically (but in opposite vertical directions).

A further air gap 9 exists between the yokes 2 and 3 and the flux plate 4. The magnetic resistance of the air gap 9 depends upon the size of the opposite surfaces of those elements and on the distance between those opposite surfaces, which is determined by the thickness of the permanent magnet 1. The overlapping area may be selected larger than the pole surfaces of the permanent magnet 1. The yokes 2 and 3 may be further conducted up to the leg 4*a* of the flux plate 4, forming another air gap 9*a* in combination therewith. For certain applications, each of the yokes 2 and 3 may have a bent tab, the tab 3*b* being the only tab visible in FIG. 1, in order to further reduce the air gaps 9 and/or 9*a*. For a specific relay, the air gaps 8 and 9 are optimized such that the relay sensitivity is as great as possible but the permanent magnet force is not too greatly attenuated due to the shunt air gap 9. This means that generally the air gap 8 should be as small as possible, in any event the air gap 8 should be significantly smaller than the air gap 9. Decreasing the air gap 9 lessens the permanent magnet attraction exerted on the armature while simultaneously increasing the relay sensitivity.

Figure 3:
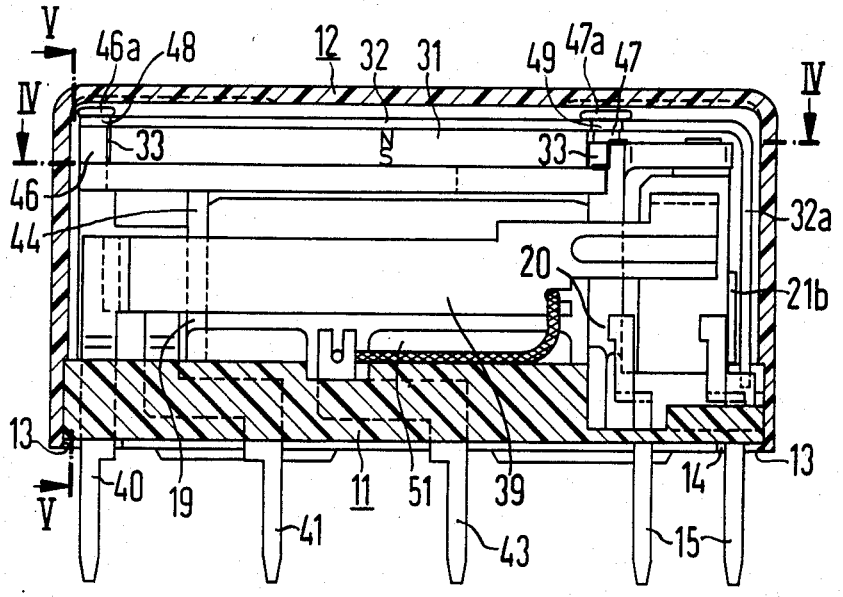
FIG. 3 is a side sectional view taken along line III—III of FIG. 4 of a relay constructed in accordance with the principles of the present invention.
Figure 4:
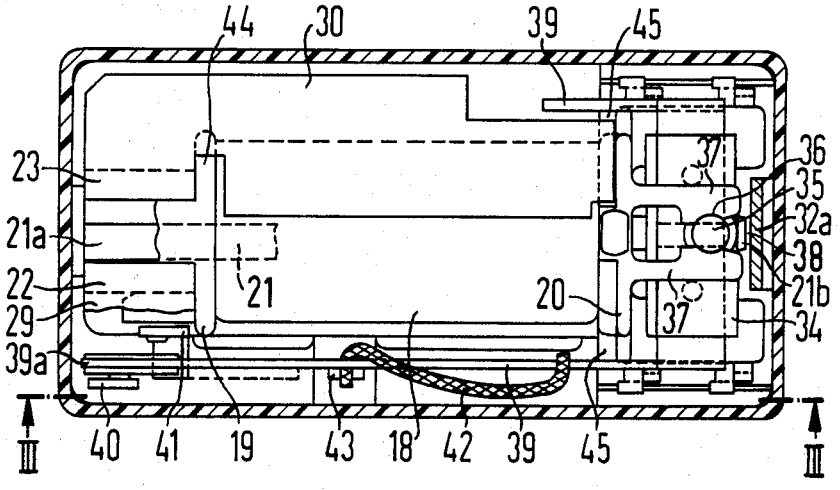
FIG. 4 is a plan sectional view taken along line IV—IV of FIG. 3 of a relay constructed in accordance with the principles of the present invention.

FIGS. 3 through 5 show various views of a relay constructed in accordance with the principles of the present invention which embodies the structure and operating concepts described in connection with FIGS. 1 and 2. The relay has a base body 11 and is closed with an insulating protective cover 12. The edge joint 13 between the base body 11 and the cover 12 is sealed with casting resin 14, as are the passages of the coil connection pins 15 through the base body 11. A coil body 17 with a coil winding 18 wound thereabout is seated on the base body 11 in a press-fit recess 16. The coil winding 18 is limited at its opposite ends by two spaced coil flanges 19 and 20. A bar-shaped armature 21 extends along the coil axis inside the coil body 17 and has a mounted end 21*b* seated at the coil flange 20 and an opposite free end 21*a* movable to execute switching movement between two spaced pole plates 22 and 23.

In order to precisely determine the width of the working air gap 24 between the two pole plates 22 and 23, respective seating surfaces 25 and 26 are provided on the coil body 17, against which the pole plates 22 and 23 are respectively pressed by noses 27 and 28 integrally formed on the coil flanges.

The pole plates 22 and 23 are extensions of respective yokes 29 and 30 which extend above the coil 18 parallel to the coil axis and to the base body 11. A flat elongated permanent magnet 31 with two oppositely polarized permanent magnet regions 31*a* and 31*b* is disposed adjacent to the yokes 29 and 30. The region 31*a* thus forms a large pole surface opposite the yoke 29, and the permanent magnet region 31*b* shares a large pole surface with the yoke 30. The pole surfaces of the quadripole permanent magnet arrangement opposite the yokes 29 and 30 are covered by a flux plate 32 which simultaneously couples the two permanent magnet regions 31*a* and 31*b* to one another and couples those two regions to the armature end 21*b* via a bent leg 32*a*.

The flux plate 32 also serves to substantially close the control flux circuit. As a result of the large surfaces which are situated opposite to the yokes 29 and 30 and opposite to the flux plate 32, a favorable air gap 33 for flux transfer is formed, the air gap 33 also continuing next to the permanent magnet 31. The air gap 33 may be optimally selected by appropriate selection of the size of the overlapping area between the yokes 29 and 30 and the flux plate 32, and by the spacing which is determined by the thickness of the permanent magnet. The air gap 33 is optimized such that the desired permanent magnetic force is available while still achieving a high sensitivity of the magnet system, thereby permitting the relay to operate with a low excitation power.

In the sample embodiment shown in FIGS. 3 through 5, the armature 21 is secured in a carrier 34 which is seated in bearing bushes 36 by means of bearing pegs 35 integrally formed on the carrier 34. The bearing bushes 36 are each formed by two resilient clamp-like retaining arms 37 which are integrally formed on the coil flange 20. By means of the carrier 34 the armature is held in a defined manner with respect to the bearing bushes 36 such that the armature end 21*b* exhibits a precisely defined air gap 38 relative to the flux plate leg 32*a*. The air gap 38 can be maintained very small and constant, because the armature end 21*b* traverses only a very short path during switching movement so that only slight friction occurs even in the event of direct contact with the flux plate leg 32*a*. In a variation not shown in the drawings, the armature 21 may be held with respect to the bearing by means of a knife-edge such that the flux plate leg 32*a* is in direct contact with the armature end 21*b*, or alternatively a foil may be inserted between those elements. Because the air gap 38 is very small in the embodiment shown in the drawings, a good coupling of both the permanent magnetic circuit and the control flux circuit of the relay is achieved.

The carrier 34 also has center contact blades 39, in the form of leaf-spring contacts, at both sides thereof which are thus securely connected to the armature 21 via the carrier 34 and therefore execute switching movements with the armature 21 without the need for a separate contact slide. The free ends 39*a* of the center contact blades 39 make and break with cooperating stationary contact elements 40 and 41. The center contact blades 39 are respectively connected to a terminal pin 43 via a flexible wire 42. The cooperating stationary contact elements 40 and 41 are anchored directly in the base body 11.

During assembly of the magnet system, the two yokes 29 and 30 are slipped onto the coil body 17 in such a manner that the pole plates 22 and 23 are positioned between the seating surfaces 25 and 26 and the noses 27 and 28. The yokes 29 and 30 respectively rest on shoulders 44 and 45 of the respective coil flanges 19 and 20, and are fixed in place together with the permanent magnet 31 and the flux plate 32 by means of two pegs 46 and 47 which are integrally formed on the thermo-plastic coil body 17. The pegs 46 and 47 extend through respective bores 48 and 49 of the flux plate 32 and are deformed above the flux plate 32 into respective rivet heads 46*a* and 47*a*.

After attachment of the protective cover 12, the operating characteristics of the relay are set by the application of external magnetic fields. The two permanent magnet regions 31*a* and 31*b* can be magnetized and calibrated in such a manner by means of applying pole shoes to the flux plate 32 such that different response values for the two armature positions are set and, as desired, a monostable or bistable switching behavior for the relay is achieved. The relay constructed in accordance with the principles of the present invention thereby permits the identical structural parts to be employed for applications requiring different relay characteristics and switching behavior and which permits the relay to be manufactured independently of the particular application for which the relay is ultimately to be used.

Although modifications and changes may be suggested by those skilled in the art it is the intention of the inventors to embody within the patent warranted hereon all changes and modifications as reasonably and properly come within the scope of their contribution to the art.

We claim as our invention:

1. A polarized electromagnetic relay comprising:

a hollow coil body having a coil wound thereabout having a longitudinal coil axis;

a bar-shaped armature having a mounted end in a pivotable bearing means disposed at one end of said coil body, said armature extending through said coil body substantially along said coil axis and terminating in a free end at an opposite end of said coil body;

a quadripole permanent magnet arrangement having first and second pole pairs with opposite polarization directions perpendicular to said coil axis;

two yokes disposed in a single plane parallel to said permanent magnet arrangement, one of said yokes being magnetically coupled to a pole of said first pole pair and the other of said yokes being magnetically coupled to an opposite pole of said second pole pair;

two pole plates respectively connected to said yokes and extending perpendicular to said coil axis for effecting movement of said free end of said armature, and a flux plate for coupling the remaining opposite poles of said first and second pole pairs to each other and to the mounted end of said armature; said flux plate having a flat segment overlapping and spaced from said yokes and said permanent magnet arrangement being disposed in the volume defined between the flat segment and said yokes longitudinally parallel to said coil axis, and said flux plate, said yokes, and said permanent magnet arrangement therebetween disposed longitudinally overlying said coil.

2. The relay of claim 1 wherein said pole plates are respectively formed by extensions of said yokes which are bent downwardly with respect to said plane containing said yokes at said opposite end of said coil body on opposite sides and parallel to said free end of said armature.

3. The relay of claim 1 wherein said overlapping area of said yokes and said flux plate extends substantially over the entire coil length.

4. The relay of claim 1 wherein said permanent magnet arrangement is a unitary element.

5. The relay of claim 1 wherein the length of said permanent magnet arrangement in the direction of said coil axis is a multiple of the thickness of the permanent magnet arrangement in the polarization directions.

6. The relay of claim 1 wherein said permanent magnet arrangement fills only a portion of said volume such that an air gap is formed between said yokes and said flux plate.

7. The relay of claim 6 wherein each of said yokes has a tab which extends substantially parallel to said flux plate and wherein said air gap is formed between said flux plate and said tabs of said yokes.

8. The relay of claim 6 wherein said flux plate has a leg for effecting said magnetic coupling to said mounted end of said armature and wherein said leg forms a further air gap with said mounted end of said armature, said further air gap being substantially smaller than said air gap between said yokes and said flux plate.

9. The relay of claim 1 wherein said flux plate presses against said mounted end of said armature and holds said armature in said bearing means.

10. The relay of claim 1 wherein said yokes are disposed between said permanent magnet arrangement and said coil winding.

11. The relay of claim 10 wherein said coil body has a pair of spaced coil flanges limiting the ends of said coil and wherein said yokes are disposed against said coil flanges and are held in place by a plurality of pegs formed onto said coil body and extending through respective corresponding bores in said yokes.

12. The relay of claim 11 wherein said pegs further extend through respective corresponding bores in said flux plate and the ends of said pegs are flattened to form rivet heads.

13. The relay of claim 1 wherein said coil body has a pair of spaced seating surfaces against which said pole plates are held and pressed by noses formed on said coil body for maintaining a specified distance between said pole plates.

14. The relay of claim 1 wherein said yokes have a combined width which is greater than the diameter of said coil and further comprising at least one contact element actuatable by said armature disposed at opposite sides of said coil respectively beneath said yokes.

15. The relay of claim 14 further comprising a base body on which said coil body is carried consisting of insulating material and having a central recess for receiving said coil body by a press-fit and in which a plurality of stationary contact terminals are anchored at opposite sides of said coil body.

16. The relay of claim 15 further comprising a protective cover consisting of insulating material inverted over said coil body and sealed to said base body.

* * * * *